US006217676B1

(12) United States Patent
Takabe et al.

(10) Patent No.: US 6,217,676 B1
(45) Date of Patent: Apr. 17, 2001

(54) STEEL FOR OIL WELL PIPE WITH HIGH CORROSION RESISTANCE TO WET CARBON DIOXIDE AND SEAWATER, AND A SEAMLESS OIL WELL PIPE

(75) Inventors: Hideki Takabe; Masakatsu Ueda, both of Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/320,469

(22) Filed: May 27, 1999

Related U.S. Application Data

(63) Continuation of application No. PCT/JP98/04349, filed on Sep. 28, 1998.

(30) Foreign Application Priority Data

Sep. 29, 1997 (JP) ..... 9-263561

(51) Int. Cl.[7] ..... C22C 38/18; C22C 38/20; C21D 9/08

(52) U.S. Cl. ..... 148/333; 148/909; 148/590

(58) Field of Search ..... 148/909, 333, 148/590

(56) References Cited

U.S. PATENT DOCUMENTS

| | | | | |
|---|---|---|---|---|
| 3,684,493 | | 8/1972 | Kubota et al. . | |
| 5,049,210 | * | 9/1991 | Miyasaka et al. | 148/909 |

FOREIGN PATENT DOCUMENTS

| | | | |
|---|---|---|---|
| 2756191 | | 7/1978 | (DE) . |
| 1568616 | | 6/1980 | (GB) . |
| 49-52117 | * | 5/1974 | (JP) . |
| 55-128566 | * | 10/1980 | (JP) . |
| 56-93856 | * | 7/1981 | (JP) . |
| 57-5846 | * | 1/1982 | (JP) . |
| 60238418 | | 11/1985 | (JP) . |
| 61006208 | | 1/1986 | (JP) . |
| 02050941 | | 2/1990 | (JP) . |
| 2-217444 | * | 8/1990 | (JP) . |
| 2-236257 | * | 9/1990 | (JP) . |
| 3-120337 | * | 5/1991 | (JP) . |
| 5-112844 | * | 5/1993 | (JP) . |
| 5-163529 | * | 6/1993 | (JP) . |
| 6128627 | * | 5/1994 | (JP) . |
| 8-3642 | * | 1/1996 | (JP) . |
| WO99/16921 | * | 4/1999 | (JP) . |

OTHER PUBLICATIONS

A. Ikeda, et al., "$CO_2$ Corrosion Behavior and Mechanism of Carbon Steel and Alloy Steel", Corrosion 83, The International Corrosion Forum Sponsored by the Nat'l Assoc. of Corrosion Engineers, Anaheim Convention Center, Anaheim, CA., Apr. 18–22, 1983, paper No. 45.*

M. Ueda et al., "Effect of Microstructure and CR Content in Steel on $CO_2$ Corrosion", Corrosion 96, The NACE International Annual Conference and Exposition, 1996, paper No. 13.*

* cited by examiner

*Primary Examiner*—Deborah Yee
(74) *Attorney, Agent, or Firm*—Burns, Doane, Swecker & Mathis, LLP

(57) ABSTRACT

A steel for oil well pipe, which has excellent resistance to localized corrosion in $CO_2$ environments and corrosion in seawater, and a seamless pipe made of the steel. The steel includes, in weight %, more than 0.10 to 0.30% C, 0.10 to 1.0% Si, 0.1 to 3.0% Mn, 2.0 to 9.0% Cr, 0.01 to 0.10% Al and optionally 0.05 to 0.5% Cu, and the balance including Fe and incidental impurities including not more than 0.03% P and not more than 0.01% S. The steel has a substantially single phase martensitic structure in the as-quenched or as-normalized condition, and yield strength of not lower than 552 MPa in the as-quenched-tempered or as-normalized-tempered condition.

19 Claims, 2 Drawing Sheets

STEEL FOR OIL WELL PIPE WITH HIGH CORROSION RESISTANCE TO WET CARBON DIOXIDE AND SEAWATER, AND A SEAMLESS OIL WELL PIPE

The present application is a continuation of PCT/JP98/04349 filed on Sep. 28, 1998 and which designated the United States of America.

FIELD OF THE INVENTION

The invention relates to a steel having corrosion resistance to carbon dioxide and/or seawater environments. The steel is useful as an oil well pipe, especially a seamless pipe.

BACKGROUND OF THE INVENTION

Recently, so-called sweet oil wells containing carbon dioxide (referred to as $CO_2$ hereafter) have been exploited because of increasing energy demand and a shortage of high quality oil resources that can be easily exploited. In addition, exploitation of rather small-scale oil wells, which have a short production life up to about 10 years because of relatively small reserves, is increasing. When the production efficiency of an oil well decreases, deaired (degassed) seawater is injected into the pipe in order to recover the oil production efficiency.

In the situation as mentioned above, an oil well pipe having high corrosion resistance to both $CO_2$ and seawater, which contains small amounts of dissolved oxygen of about 500 ppb, is required. The seawater containing a small amount of dissolved oxygen as mentioned above, is referred to as "seawater" in this specification.

Conventionally an inhibitor is used to suppress corrosion of carbon steel pipes, when the pipe is used for both oil production and seawater injection. The inhibitor, however, not only increases production cost but also induces pollution. Therefore, there is a need in the art for an oil well pipe of steel which has sufficient corrosion resistance to eliminate the inhibitor.

It is known from the publications by A. Ikeda, M. Ueda and S. Mukai "Corrosion/83" NACE Houston, Paper No. 45, 1983, and Masakatsu Ueda and A. Ikeda "Corrosion/96" NACE Houston, Paper No. 13, 1996 that the corrosion rate of steel in $CO_2$ environments decreases and resistance to general corrosion is improved, according to an increase of Cr content. In fact, the JIS SUS 410 series steels, which contain 12 to 13% of Cr ("%" for content of alloy elements means weight % in this specification) have already been utilized for oil well pipe.

However, the SUS 410 series steels are expensive because of the high Cr content thereof. In addition, such high Cr steels have a disadvantage in that they suffer localized corrosion (pitting) in seawater containing little dissolved oxygen.

A steel containing smaller amounts of Cr and cheaper than the 12 to 13% Cr steel is desired for an oil well pipe used for short life wells as described above. Furthermore, considering seawater injection, a steel having resistance to localized and general corrosion in seawater, i.e., a seawater resistant steel, is necessary.

Japanese Examined Patent Application 53-38687 discloses a low alloy seawater resistant steel containing 1.0 to 6.0% Cr and 0.1 to 3.0% Al. However, this steel is not for an oil well pipe, and the $CO_2$ corrosion resistance thereof is not known.

Japanese Laid-Open Patent Publication No. 57-5846 discloses a steel containing 0.5–5% Cr and having resistance to sweet corrosion. While this reference states that such steel has good corrosion resistance in seawater containing $CO_2$, the resistance is merely the general corrosion resistance, which has been estimated by corrosion weight loss. In addition, the microstructure thereof cannot be determined because the producing method of the steel is not disclosed.

Japanese Examined Patent Application No. 57-37667 proposes a wet $CO_2$ resistant steel for line pipes, which contains more than 3.0% to 12.0% Cr. This steel's resistance against localized corrosion is improved in specific areas such as the welded portion, where the heat treatment history is different from other areas. The steel, however, cannot have a single phase martensite microstructure because of its low C content. Therefore, its tensile strength is low and its resistance to localized corrosion when used as a pipe is not sufficient.

Japanese Laid-Open Patent Publication No. 5-112844 discloses a steel pipe, which has good $CO_2$ corrosion resistance and can be used for oil well pipes. However, the Cr content of this steel pipe is as low as 0.25–1.0%. Further, the pipe was not designed to improve the seawater corrosion resistance. In addition, the $CO_2$ corrosion resistance of this pipe is improved mainly by a decarburized layer of more than 100 $\mu$m thickness, which is formed in the inner surface of the pipe.

As mentioned above, it is already well known that increasing the Cr content improves the general corrosion resistance of the steel in $CO_2$ environments. However, it is uneconomical to use steel having more than 10% Cr for short life oil wells such as 10 years or less. In addition, steel containing such a high content of Cr has the disadvantage of localized corrosion (pitting) in seawater of low dissolved oxygen. The oil well pipe becomes useless after suffering localized corrosion, which passes through the pipe wall, even if it has good general corrosion resistance. This means that not only general corrosion resistance but also localized corrosion resistance is remarkably important in a steel for an oil well pipe.

SUMMARY OF THE INVENTION

An objective of the present invention is to provide a steel that can exhibit one or more of the following properties:

1) Yield strength not less than 552 MPa (yield strength of API 80 grade or more) in a heat-treated condition by quenching-tempering or normalizing-tempering;
2) Superior resistance to localized corrosion in wet $CO_2$ environments and seawater of low dissolved oxygen; and
3) Superior resistance to general corrosion in seawater of low dissolved oxygen.

Another objective of the present invention is to provide a comparatively inexpensive seamless oil well pipe made of the above mentioned steel.

The inventors have investigated the means to improve the resistance of steel for an oil well pipe to localized corrosion in $CO_2$ environments and corrosion in seawater. The inventors thereby have found the fact that the resistance not only to localized corrosion in $CO_2$ environments, but also to the corrosion in seawater can be remarkably improved by making the microstructure substantially of single phase martensite in a condition as quenched or as normalized.

It is known that localized corrosion resistance to wet $CO_2$ environments of Cr-free carbon steel depends on the microstructure, and it is also known that the ferrite - pearlite duplex (dual-phase) structure is better than the single homogeneous martensite structure for localized corrosion resistance. However, according to the investigation by the present inventors, in steel containing Cr, the single phase martensitic structure has superior resistance to localized corrosion in wet $CO_2$ environments.

This invention provides, on the basis of the foregoing finding, a steel for an oil well pipe, which can have the following characteristics.

(a) Chemical Composition:

The steel consists essentially of, in weight %, more than 0.10 to 0.30% of C, 0.10 to 1.0% of Si, 0.1 to 3.0% of Mn, 2.0 to 9.0% of Cr and 0.01 to 0.10% of Al, and the balance of Fe and incidental impurities including not more than 0.03% P and not more than 0.01% S. Furthermore, 0.05 to 0.5% of Cu, as an alloy element, may also be contained in the steel.

(b) Microstructure:

The microstructure is substantially single phase martensite in the as-quenched or as-normalized condition. The terminology "substantially single phase martensite" denotes a microstructure in which about 95% or more, in the cross-sectional area ratio, is martensite. In addition to martensite, less than about 5% in total of ferrite, bainite and/or pearlite can be allowed in the microstructure.

(c) Strength:

The yield strength is not lower than 552 MPa after heat treatment of "quenching-tempering" or "normalizing-tempering".

The present invention also provides a seamless oil well pipe, which is made of the above-mentioned steel and has excellent resistance to wet $CO_2$ corrosion and seawater corrosion.

DETAILED DESCRIPTION OF THE INVENTION

Figure 1:
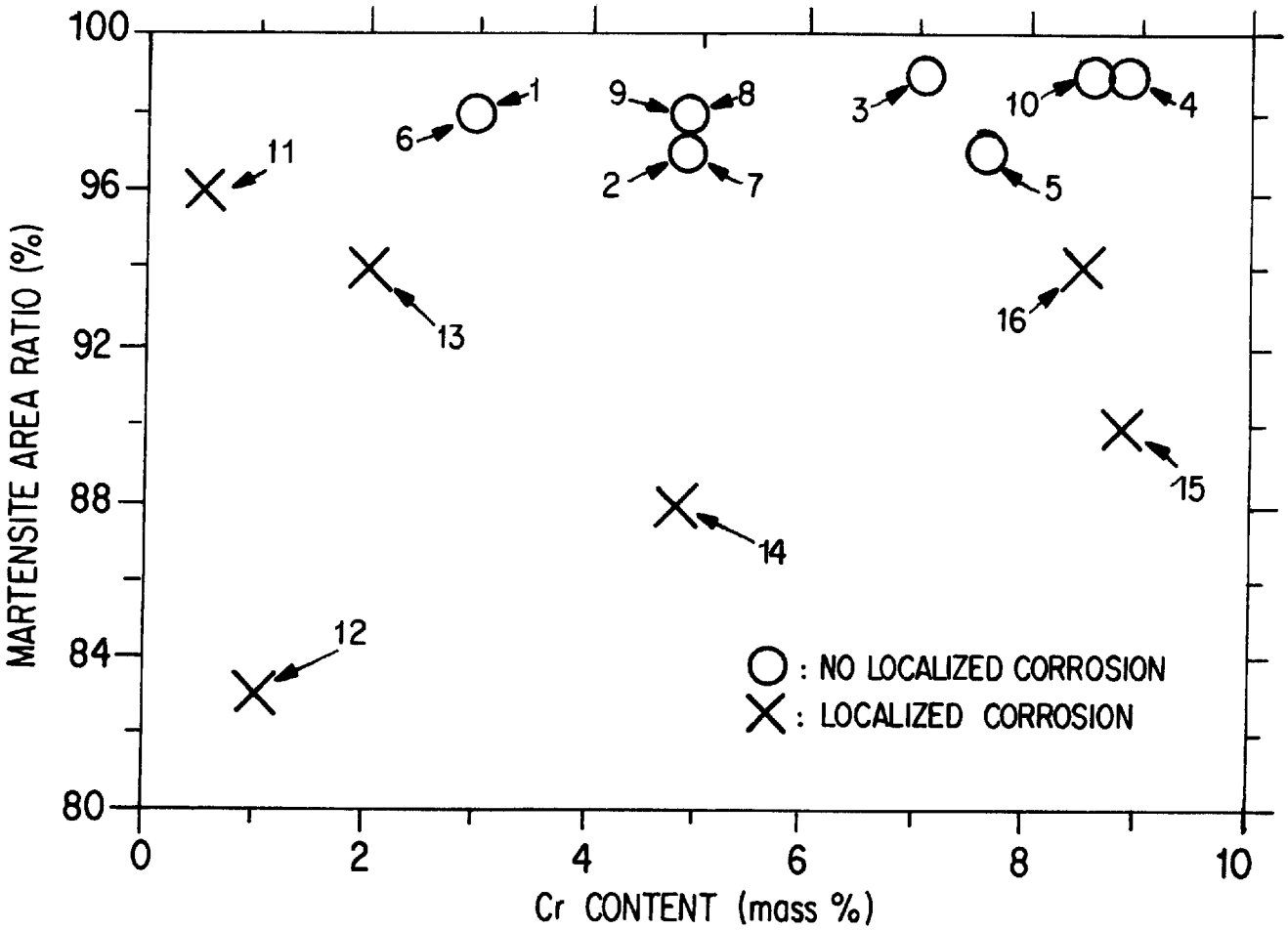
FIG. 1 is a graph showing the relationship between Cr contents and martensite area ratio, and localized corrosion resistance in wet $CO_2$ environments and artificial seawater.

The steel for oil well pipe of this invention preferably has all of the characteristics from (a) to (c) as mentioned above. Each of these characteristics will be described hereafter.

1. Chemical Composition of the Steel

First, the reasons for selecting the above mentioned alloy elements and amounts thereof will be described.

C: Carbon is necessary to improve hardenability of the steel and to make its structure substantially single phase martensite, and thereby to confirm corrosion resistance and the strength of the steel. If the amount of C is no more than 0.10%, the hardenability is not enough to obtain the martensite structure and neither its corrosion resistance nor strength is sufficient. On the other hand, more than 0.30% C induces quenching cracks, which makes production of the seamless pipe difficult. Therefore, the amount of C is selected in the range of more than 0.10 to 0.30%. More preferably, the C range is more than 0.10 to 0.25%.

Si: Silicon is used as a deoxidizing agent of the steel, and its content of not less than 0.10% is necessary. More than 1.0% Si, however, has an unfavorable effect on the workability and the toughness of the steel.

Mn: Not less than 0.1% manganese is necessary to improve the strength and the toughness of the steel. However, more than 3.0% Mn decreases resistance to $CO_2$ corrosion. The preferred range of Mn content, therefore, is 0.1 to 3.0%.

Cr: Chromium improves hardenability of the steel to increase strength and corrosion resistance in a wet $CO_2$ environment and also in seawater, which contains a small amount of dissolved oxygen. If the Cr content is less than 2.0%, the effect is not sufficient. On the other hand, addition of large amounts of Cr makes the steel expensive. Further, in the steel containing more than 9.0% Cr, localized corrosion occurs easily in seawater and toughness decreases. Therefore, the preferred range of Cr content is 2.0 to 9.0%. From the viewpoint of balance of steel cost and properties, the most preferable range is 3.0 to 7.0% Cr.

Al: Aluminum is used as a deoxidizing agent of the steel. If its content is less than 0.01%, there is a possibility of insufficient deoxidization. On the other hand, more than 0.10% Al deteriorates mechanical properties, such as toughness.

Cu: Although copper is not an indispensable element, it can optionally be contained in the steel because it is effective in order to improve seawater corrosion resistance. Such effect is insufficient when its content is lower than 0.05%. On the other hand, more than 0.5% Cu deteriorates hot workability of the steel. Therefore, the Cu content is preferably in the range 0.05 to 0.5% when it is added.

The steel of this invention consists essentially of the above-mentioned elements and the balance Fe and incidental impurities to obtain the desired corrosion resistance and/or strength. Among the impurities, particularly P and S should be limited as follows.

P: Phosphorus is inevitably contained in the steel. Since more than 0.03% P segregates on grain boundaries and decreases the toughness of the steel, it is limited to not more than 0.03%.

S: Sulfur also is inevitably contained in the steel and combines with Mn to form MnS and deteriorates toughness of the steel. Therefore, the content of S is limited to not more than 0.01%.

2. Microstructure

One of the remarkable characteristics of the steel according to this invention is its microstructure which is substantially single phase martensite. Steel pipes made of the steel of this invention can be utilized in an as-tempered condition after quenching or after normalizing. Therefore, the final structure would be substantially single phase tempered martensite.

Depending on the above mentioned chemical composition and microstructure, the steel of this invention has resistance to localized corrosion in wet $CO_2$ environments, resistance to seawater corrosion and sufficient strength. As previously described, "substantially single phase martensite" means the structure consisting of, in area % (measured by microscopic inspection), of about 95% or more of martensite. It is preferable that the martensite is not less than 98%.

The reason for improvement of localized corrosion resistance in wet $CO_2$ environments and seawater by the microstructure consisting of substantially single phase martensite has not yet become clear. However, a possible mechanism for the improvement is described below.

Localized corrosion does not proceed while the product of corrosion, which is formed in corrosive environments, uniformly covers the surface of the steel. The structure of the corrosion product depends on the steel structure. Therefore, if the structure of the steel is single phase nartensite, localized corrosion does not occur because the corrosion product uniformly covers the surface of the steel. If any structures, other than martensite, exist in amounts of about 5% or more, the corrosion product on those structures becomes different from the corrosion product on the martensite. Such a different corrosion product or partial peeling off of the corrosion product induces the localized corrosion.

The above mentioned structure can be obtained by heat treatment, conditions for which are properly determined depending on the chemical composition of the steel. For example, a substantially single phase martensite structure can be formed in a process, wherein the steel is heated in a range of 900–1100° C. and cooled with a controlled cooling rate in water cooling (quenching) or air cooling (normalizing). Tempering can be carried out at a temperature in a range of 450–700° C.

3. Strength of the Steel

The steel of this invention has a yield strength of 552 MPa or more, in the condition as quenched-tempered or normalized-tempered as mentioned above. This yield strength corresponds to those of oil well pipes of Grade 80 (minimum yield strength is 80,000 psi) or higher, standardized in API (American Petroleum Institute). Therefore, the oil well pipe made of the steel of this invention can be utilized as high strength oil well pipes of Grade 80 or higher.

Although the above mentioned steel of this invention may be used for welded oil well pipe, it is more suitable for seamless oil well pipes. Those pipes can be manufactured by a conventional method. The seamless pipe can be manufactured in the Mannesmann process, the hot-extruding process, etc. After manufacturing, the pipe can be heat treated in order to obtain a substantially single phase tempered martensitic structure.

EXAMPLE

Steels having chemical compositions shown in Table 1 were produced in a vacuum furnace and cast into ingots of 550 mm diameter. Then these ingots were hot forged into billets of 150 mm diameter at 1200° C. Seamless pipes of 188 mm outer diameter and 12 mm thickness were manufactured from the billets by the Mannesmann pipe making process.

The pipes were heated at 900–1100° C. and quenched or normalized to obtain a microstructure having 83–99 area % martensite. The area % of martensite was varied by controlling the heating temperature in the 900 to 1100° C. range and cooling at a rate in a range of 5–40° C./sec, depending on the chemical compositions of the steels.

Test specimens for microscopic inspection were cut out of the pipes as quenched or as normalized, in order to examine the martensite area %. Thereafter, the pipes were tempered in a temperature range of 500–650° C. to make pipes, which have a yield strength of API Grade 80 (yield strength: 552–655 MPa).

Using samples obtained from the pipes, hardness, tensile and corrosion tests, as mentioned hereinafter, were carried out.

(A) Hardness Test

HRC hardness was measured on cross sections vertical to the longitudinal direction of the sample pipes (pipes tempered after being quenched or normalized).

(B) Tensile Test

Test specimens, having 4.0 mm diameter and 20 mm parallel length were cut out of the sample pipes. Tests were carried out at room temperature, and yield strength at 0.5% total elongation and tensile strength were measured. Ratios of the yield strength to tensile strength (Yield ratio, YR) were also calculated.

(C) Martensite Area Ratio

Ten visual fields of each cross section, vertical to the longitudinal direction of the pipes as quenched or normalized, were inspected with an optical microscope at 100 magnification. Martensite area ratios were measured thereby, and averages of the measurements were calculated.

(D) Localized Corrosion Test in Wet $CO_2$ Environments

Test specimens of 22 mm width, 3 mm thickness and 76 mm length were cut out of the sample pipes. The specimens were tested, after being polished with No. 600 emery paper, degreased and dried, by immersing for 720 hours in the following test solution. Weight losses of the specimens, after removing the corrosion product, were measured and existence of localized corrosion was visually investigated.

Test Solution:

5% NaCl solution saturated with 3 bar $CO_2$ agitated at flow rate of 2.5 mm/s and heated to 80° C.

(E) Sea Water Corrosion Test

Test specimens of 22 mm width, 3 mm thickness and 76 mm length, cut out of the sample pipes, polished with No. 600 emery paper, degreased and dried, were used. The specimens were immersed in artificial seawater with 500 ppb dissolved oxygen (according to ASTM D 1141-52 standard) for 72 hours. Thereafter, the corrosion product on the specimens was removed and weight losses thereof were measured. Existence of localized corrosion was also investigated by visual inspection.

Test results are shown in Table 1, wherein "o" means no localized corrosion in the wet $CO_2$ corrosion test or the artificial seawater corrosion test and "X" means existence of localized corrosion in those tests.

FIG. 1 is a graph, which shows the relationship between Cr content, martensite ratio, and resistance to localized corrosion in $CO_2$ environments and artificial seawater.

Figure 2:
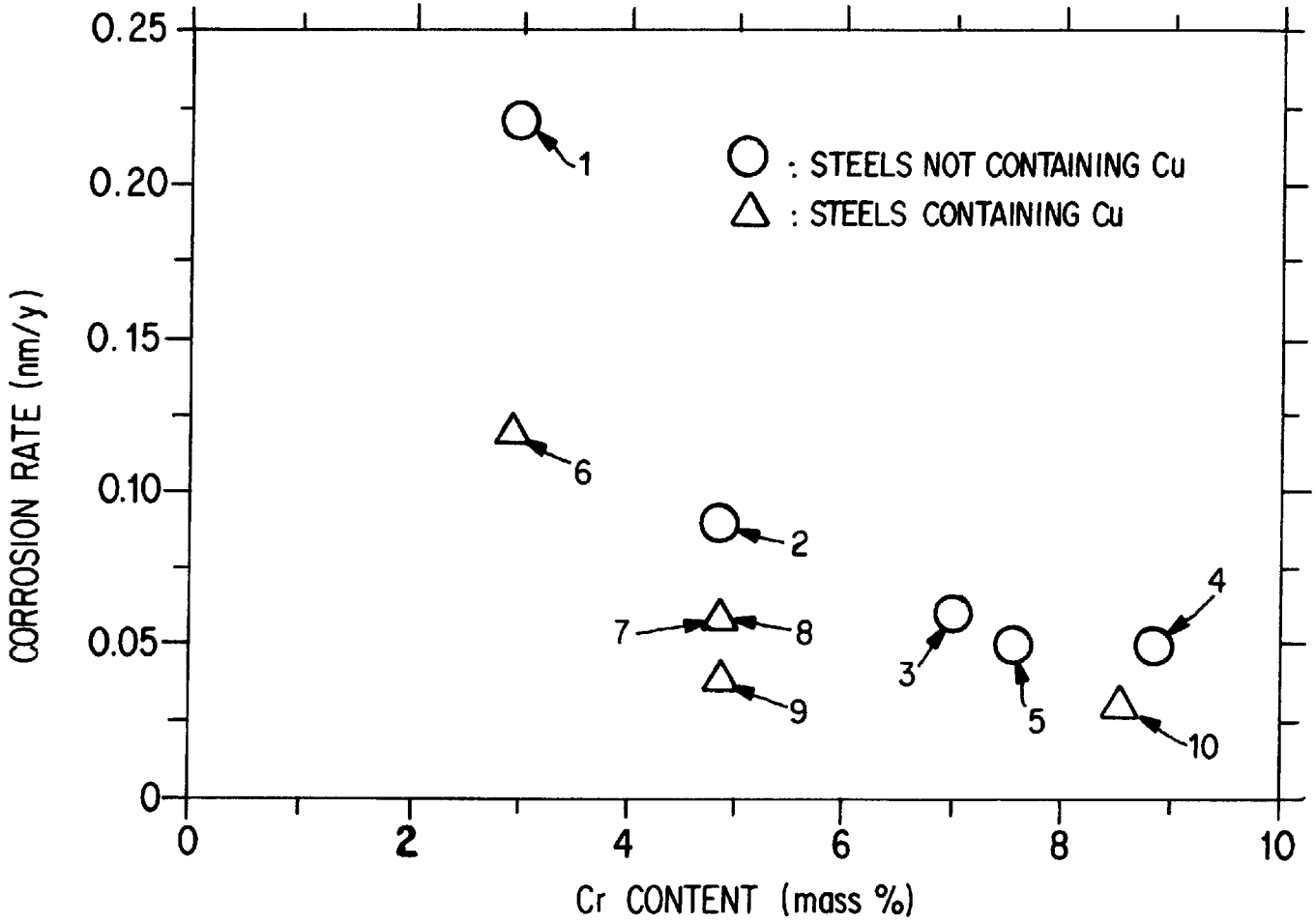
FIG. 2 is a graph showing the relationship between Cr contents of 2.0 to 9.0% Cr steel according to the present invention and the corrosion rate in artificial seawater.

FIG. 2 is a graph, which shows the relationship between Cr content of the steels according to this invention and corrosion rate in the artificial seawater. The numbers associated with the "x" and "o" symbols in FIGS. 1 and 2 correspond to the samples listed in Table 1.

It is apparent from the test results in Table 1, FIG. 1 and FIG. 2 that the steels of this invention (Nos. 1–10), which have more than 95 area % martensite as quenched or normalized, never suffered localized corrosion in either $CO_2$ environments or artificial seawater. These steels have good resistance to general corrosion in artificial seawater and high strength such as yield strength of not lower than 552 MPa at 0.5% total elongation.

Samples 6–10 are Cu containing steels according to this invention. The corrosion rates of these steels are much smaller.

Samples 11–16 are comparative steels. Among them Samples 11 and 12 are inferior in resistance to general corrosion in seawater and also suffer localized corrosion because of the lower Cr content. Samples 13–16 have chemical compositions according to this invention, but the martensite ratios are low. Therefore, while all of them suffer localized corrosion in seawater and wet $CO_2$ environments, some of them (Samples 14–16) show good resistance to general corrosion in seawater. It is apparent from the test data that not only selection of the proper chemical composition but also the presence of a substantially single phase martensite structure is necessary to prevent localized corrosion.

The steel of the present invention is excellent in resistance to localized corrosion in both wet $CO_2$ environments and seawater as well as resistance to general corrosion in seawater. In addition, the steel of the present invention has yield strength of not lower than 552 MPa, in the quenched-tempered or normalized-tempered condition.

Since steel pipes made of the steel of this invention are relatively cheap, they can be utilized, as oil well pipes for environments in which the pipes are exposed to $CO_2$ and seawater, even in short life oil wells.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

TABLE 1

| Steels of this Invention | Chemical Composition (weight %, Balance: Fe and impurities) | | | | | | | | Martensite Area Ratio | Yield Strength | Tensile Strength | YR | HRC Hardness | Localized Corrosion in $CO_2$ Environments | Corrosion in Artificial Seawater: Localized Corrosion | Corrosion in Artificial Seawater: Corrosion Rate |
|---|---|---|---|---|---|---|---|---|---|---|---|---|---|---|---|---|
| No. | C | Si | Mn | P | S | Cr | Al | Cu | (%) | (MPa) | (MPa) | (%) | | | | (mm/y) |
| 1 | 0.13 | 0.26 | 1.14 | 0.011 | 0.006 | 2.96 | 0.033 | — | 98 | 614.4 | 729.1 | 84.3 | 18.9 | ○ | ○ | 0.22 |
| 2 | 0.14 | 0.25 | 1.10 | 0.009 | 0.006 | 4.82 | 0.034 | — | 97 | 616.3 | 742.9 | 83.0 | 20.4 | ○ | ○ | 0.09 |
| 3 | 0.11 | 0.12 | 0.23 | 0.025 | 0.004 | 7.02 | 0.087 | — | 99 | 688.8 | 819.6 | 84.0 | 22.7 | ○ | ○ | 0.06 |
| 4 | 0.13 | 0.27 | 1.11 | 0.010 | 0.006 | 8.85 | 0.032 | — | 99 | 653.3 | 770.6 | 84.8 | 20.8 | ○ | ○ | 0.05 |
| 5 | 0.18 | 0.89 | 0.75 | 0.009 | 0.005 | 7.56 | 0.044 | — | 97 | 733.1 | 863.6 | 84.9 | 25.6 | ○ | ○ | 0.05 |
| 6 | 0.12 | 0.26 | 1.12 | 0.008 | 0.006 | 2.94 | 0.031 | 0.22 | 98 | 638.9 | 743.3 | 86.0 | 20.3 | ○ | ○ | 0.12 |
| 7 | 0.12 | 0.23 | 1.01 | 0.009 | 0.006 | 4.85 | 0.033 | 0.09 | 97 | 630.2 | 741.5 | 85.0 | 19.1 | ○ | ○ | 0.06 |
| 8 | 0.13 | 0.22 | 0.99 | 0.011 | 0.005 | 4.89 | 0.031 | 0.25 | 98 | 678.5 | 801.2 | 84.7 | 21.2 | ○ | ○ | 0.06 |
| 9 | 0.13 | 0.25 | 1.08 | 0.009 | 0.006 | 4.87 | 0.028 | 0.47 | 98 | 654.1 | 780.5 | 85.0 | 20.2 | ○ | ○ | 0.04 |
| 10 | 0.13 | 0.22 | 0.99 | 0.011 | 0.008 | 8.55 | 0.035 | 0.46 | 99 | 691.6 | 799.3 | 84.7 | 21.6 | ○ | ○ | 0.03 |
| Comparative Steels No. | | | | | | | | | | | | | | | | |
| 11 | 0.23 | 0.27 | 1.23 | 0.028 | 0.009 | 0.52 | 0.044 | — | 96 | 580.3 | 690.4 | 84.1 | 17.5 | X | X | 0.62 |
| 12 | 0.27 | 0.23 | 2.57 | 0.009 | 0.008 | 1.05 | 0.041 | — | 83 | 612.4 | 735.4 | 83.3 | 19.5 | X | X | 0.57 |
| 13 | 0.25 | 0.25 | 1.80 | 0.010 | 0.006 | 2.01 | 0.046 | — | 94 | 607.5 | 733.5 | 82.8 | 20.8 | X | X | 0.47 |
| 14 | 0.14 | 0.25 | 1.10 | 0.009 | 0.006 | 4.82 | 0.034 | — | 88 | 612.7 | 733.1 | 83.6 | 19.2 | X | X | 0.16 |
| 15 | 0.13 | 0.27 | 1.11 | 0.010 | 0.006 | 8.85 | 0.032 | — | 90 | 681.7 | 802.7 | 84.9 | 21.6 | X | X | 0.04 |
| 16 | 0.12 | 0.26 | 1.08 | 0.010 | 0.005 | 8.50 | 0.030 | — | 94 | 653.2 | 775.5 | 84.2 | 19.1 | X | X | 0.03 |

What is claimed is:

1. A steel having excellent resistance to wet $CO_2$ corrosion and seawater corrosion comprising, in weight %, more than 0.10 to 0.30% C, 0.10 to 1.0% Si, 0.1 to 3.0% Mn, 2.5 to less than 7.0% Cr and 0.01 to 0.10% Al, the balance including Fe and incidental impurities including not more than 0.03% P and not more than 0.01% S, the steel having a microstructure in which 95% or more is martensite in an as-quenched or as-normalized condition, and a yield strength of not lower than 552 MPa in an as-quenched-tempered or normalized-tempered condition.

2. A steel having excellent resistance to wet $CO_2$ corrosion and seawater corrosion comprising, in weight %, more than 0.10 to 0.30% C, 0.10 to 1.0% Si, 0.1 to 3.0% Mn, 2.5 to less than 7.0% Cr, 0.01 to 0.10% Al and 0.05 to 0.5% Cu, the balance including Fe and incidental impurities including not more than 0.03 % P and not more than 0.01% S, the steel having a microstructure in which 95% or more is martensite in an as-quenched or as-normalized condition, and a yield strength of not lower than 552 MPa in an as-quenched-tempered or normalized-tempered condition.

3. A seamless oil well pipe made of the steel according to claim 1.

4. A seamless oil well pipe, according to claim 3, for environments in which the pipes are exposed to $CO_2$ and seawater.

5. A seamless oil well pipe made of the steel according to claim 2.

6. A seamless oil well pipe, according to claim 5, for environments in which the pipes are exposed to $CO_2$ and seawater.

7. The steel according to claim 1, consisting essentially of more than 0.10 to 0.30% C, 0.10 to 1.0% Si, 0.1 to 3.0% Mn, 2.5 to less than 7.0% Cr and 0.01 to 0.10% Al, the balance being Fe and incidental impurities including not more than 0.03% P and not more than 0.01% S.

8. The steel according to claim 2, consisting essentially of more than 0.10 to 0.30% C, 0.10 to 1.0% Si, 0.1 to 3.0% Mn, 2.5 to less than 7.0% Cr, 0.01 to 0.10% Al and 0.05 to 0.5% Cu, the balance being Fe and incidental impurities including not more than 0.03% P and not more than 0.01% S.

9. The steel according to claim 1, wherein a total amount of martensite is more than 97%.

10. The steel according to claim 2, wherein a total amount of martensite is more than 97%.

11. The steel according to claim 1, wherein the steel has been heated to 900 to 1100° C. followed by air cooling or water quenching.

12. The steel according to claim 2, wherein the steel has been heated to 900 to 1100° C. followed by air cooling or water quenching.

13. The steel according to claim 1, wherein the steel has been tempered at 450 to 700° C.

14. The steel according to claim 2, wherein the steel has been tempered at 450 to 700° C.

15. The steel according to claim 1, wherein the Cr content is 3.0 to less than 7.0%.

16. The steel according to claim 2, wherein the Cr content is 3.0 to less than 7.0%.

17. The steel according to claim 1, wherein the C content is more than 0.10 to 0.25%.

18. The steel according to claim 2, wherein the C content is more than 0.10 to 0.25%.

19. The steel according to claim 2, wherein the Cu content is at least 0.2%.

* * * * *